US007620338B2

(12) United States Patent
Yamada et al.

(10) Patent No.: US 7,620,338 B2
(45) Date of Patent: Nov. 17, 2009

(54) FIXING APPARATUS HAVING A CURIE POINT HEATER AND IMAGE FORMING APPARATUS

(75) Inventors: Hideaki Yamada, Tochigi (JP); Hajime Makishima, Tochigi (JP); Yukio Arai, Saitama (JP); Noriyuki Tajima, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/850,733

(22) Filed: Sep. 6, 2007

(65) Prior Publication Data

US 2008/0069582 A1 Mar. 20, 2008

(30) Foreign Application Priority Data

Sep. 15, 2006 (JP) ..... 2006-250896

(51) Int. Cl.
*G03G 15/20* (2006.01)

(52) U.S. Cl. ..... 399/70; 399/69; 399/320; 399/328; 399/329; 219/216; 219/619

(58) Field of Classification Search ..... 399/69, 399/70, 320, 328, 329; 219/216, 619
See application file for complete search history.

(56) References Cited

U.S. PATENT DOCUMENTS 6,807,386 B2 * 10/2004 Yasui et al. ..... 399/69
7,098,430 B2 * 8/2006 Kondo et al. ..... 219/619
7,122,769 B2 * 10/2006 Nami et al. ..... 219/619
7,349,662 B2 * 3/2008 Nanjo ..... 399/328
2002/0006296 A1 * 1/2002 Omoto et al. ..... 399/330
2005/0173415 A1 * 8/2005 Yamamoto et al. ..... 219/619
2006/0081614 A1 * 4/2006 Nami et al. ..... 219/619
2006/0088329 A1 * 4/2006 Suzuki et al. ..... 399/69
2006/0131301 A1 * 6/2006 Ohta et al. ..... 219/619
2006/0245778 A1 * 11/2006 Kachi ..... 399/69
2007/0014599 A1 1/2007 Yasuda et al.
2007/0122214 A1 5/2007 Samei et al.

(Continued)

FOREIGN PATENT DOCUMENTS

JP 2002-11217 1/2002

(Continued)

OTHER PUBLICATIONS

English language Abstract of JP 2002-23557.

(Continued)

*Primary Examiner*—David M Gray
*Assistant Examiner*—G. M. Hyder
(74) *Attorney, Agent, or Firm*—Greenblum & Bernstein P.L.C.

(57) ABSTRACT

A fixing apparatus has a heater that includes a magnetic shunt alloy whose Curie temperature is set higher than a fixing temperature; an induction heater that generates an alternating magnetic field applied to the magnetic shunt alloy and performs electromagnetic-induction heating on the heater; and a body controller that controls the induction heater so as to adjust the fixing temperature in each fixing job. The body controller controls the induction heater so as to perform electromagnetic-induction heating on the heater, during a period between fixing jobs. The body controller thereby reduces a temperature difference generated on the heater between portions corresponding to paper feeding and non-paper feeding areas in a previously executed fixing job.

11 Claims, 12 Drawing Sheets

U.S. PATENT DOCUMENTS

| | | | | |
|---|---|---|---|---|
| 2007/0127958 | A1* | 6/2007 | Matsuura et al. | 399/328 |
| 2007/0212091 | A1* | 9/2007 | Kinouchi et al. | 399/69 |
| 2007/0274748 | A1* | 11/2007 | Yoshikawa | 399/329 |
| 2008/0061054 | A1* | 3/2008 | Shirakata et al. | 219/619 |

FOREIGN PATENT DOCUMENTS

| | | |
|---|---|---|
| JP | 2002-23557 | 1/2002 |
| JP | 2006-30885 | 2/2006 |

OTHER PUBLICATIONS

English language Abstract of JP 2006-30885.
English language Abstract of JP 2002-11217.

* cited by examiner

FIXING APPARATUS HAVING A CURIE POINT HEATER AND IMAGE FORMING APPARATUS

BACKGROUND OF THE INVENTION

1. Field of the Invention

The present invention relates to a fixing apparatus employing an electromagnetic-induction method and an image forming apparatus having the fixing apparatus.

2. Description of Related Art

Conventionally, image forming apparatuses such as copier, printer, facsimile and multifunction apparatus are known to employ a fixing apparatus that uses a so-called electromagnetic-induction heating method. When employing the fixing apparatus using the electromagnetic-induction heating method, it is possible to reduce warm-up time and power consumption compared to a fixing apparatus that employs a conventional lamp heating method using a halogen lamp or the like.

When employing the fixing apparatus using the electromagnetic-induction heating method, it is preferred to reduce thicknesses of heating and fixing rollers and thus heat capacity of the rollers, in order to shorten the time to heat the rollers. However, this effort increases heat resistance of the rollers in the axial direction, thereby causing temperature difference of the rollers in the axial direction. The temperature difference of the rollers may cause adverse effects to a fixing process, such as uneven gloss level of the printed image and hot offset. In order to manage this problem, a technology is known to reduce the temperature difference of the rollers in the axial direction in order to properly perform the fixing process.

For example, an induction coil for an induction heat-generating roller can be configured with a first induction coil and a second induction coil, the first induction coil having a heating area that corresponds to a predetermined paper size width, the second induction coil having a heating area outside of the heating area of the first induction coil. A first and a second thermometers are disposed to detect roller surface temperatures of respective first and second induction coils. At the same time, a target temperature is set for each heating area of the corresponding induction coil, and current capacity to each induction coil is separately controlled (see Related Art 1).

Further, for instance, a fixing apparatus is known which has a fixing member, a coil, and a core, the fixing member heating a toner image so as to fix the toner image to a recording medium, the coil being provided opposite to the fixing member and extending in a width direction, the core being configured to change an area opposite to the coil. Changing the area opposite to the core can adjust a heating area on the fixing member in the width direction, the area being heated by electromagnetic induction of the coil (see Related Art 2).

Furthermore, for instance, a fixing apparatus is known which has a fixing roller, an opposite roller, a fixing belt, an induction heater, and a pressure roller, the opposite roller being provided in parallel to the fixing roller and having nonmagnetic material, the fixing belt being an endless belt wound around the fixing roller and the opposite roller, the induction heater performing electromagnetic-induction heating on the fixing belt, the pressure roller pressing the fixing roller via the fixing belt. The fixing belt has a layer structure that includes a base material, an elastic layer, and a release layer in order from a lower side. The base material is formed of a material dispersed with magnetic shunt alloy, whose Curie temperature is set lower than a hot offset temperature of toner (see Related Art 3).

[Related Art 1] Japanese Patent Laid-open Publication No. 2002-23557

[Related Art 2] Japanese Patent Laid-open Publication No. 2006-30885

[Related Art 3] Japanese Patent Laid-open Publication No. 2006-11217

When the above-described fixing apparatuses continuously process (feed) recording paper having a predetermined width, a temperature difference occurs on the rollers between portions corresponding to paper feeding and non-paper feeding areas of the recording paper. When recording paper having a wider width is fed thereafter, a gloss level may vary between the paper feeding and non-paper feeding areas because of a fixing temperature difference. It is difficult, however, to properly solve such a problem with the above-described conventional technologies.

More specifically, the conventional technology described in Related Art 1 above can evenly distribute the fixing temperature in the axis direction, when feeding recording paper having a predetermined paper width corresponding to the heating area of the first induction coil. However, the technology cannot handle recording paper having a different width, thus causing a problem of an uneven fixing temperature. In this case, the induction coil may be configured to include an increased number of coils so as to deal with a variety of recording paper widths (i.e., the induction coil is more divided), which, however, causes a problem that complicates the structure of the fixing apparatus.

Further, the conventional technology described in Related Art 2 above requires a mechanism (a motor or the like) for rotating the core in order to change the area opposite to the coil, thus complicating the structure of the fixing apparatus. Controlling the temperature in accordance with a plurality of recording paper widths, in particular, requires setting of a temperature sensor for each of the paper widths, thus increasing cost and complicating power control.

In the conventional technology described in Related Art 3 above, the non-paper feeding area may be maintained at a temperature lower than a hot offset temperature in a predetermined fixing job. When the temperature difference occurs between the paper feeding and non-paper feeding areas at a predetermined level or more, however, the gloss level varies when recording paper having a wider width is fed in a subsequent fixing job. In order to reduce such a temperature difference, the Curie temperature may be set around the fixing temperature. In this case, however, heating efficiency declines near the fixing temperature, thus causing a problem that extends warm-up time.

SUMMARY OF THE INVENTION

The present invention is provided to address the above-described problems in the conventional technologies. A main object of the present invention is to provide a fixing apparatus and an image forming apparatus having the same, the fixing apparatus having a simple structure that can reduce a temperature difference generated on a heater between portions corresponding to paper feeding and non-paper feeding areas of recording paper in a previously executed fixing job and that can maintain an even gloss level on a printed image by equalizing a fixing temperature in a width direction of a recoding paper even when processing recording paper having a wider width in a subsequent job.

A fixing apparatus according to the present invention executes a plurality of fixing jobs for recording paper having different widths. The fixing apparatus has a heater that includes a magnetic shunt alloy whose Curie temperature is set higher than a fixing temperature in each of the plurality of fixing jobs; an induction heater that generates an alternating magnetic field applied to the magnetic shunt alloy and performs electromagnetic-induction heating on the heater; and a heating controller that controls the induction heater so as to adjust the fixing temperature in each of the fixing jobs. The heating controller controls the induction heater so as to perform electromagnetic-induction heating on the heater, during a period from an end of a preceding fixing job to a start of a subsequent fixing job.

According to the present invention as described above, the simple structure has excellent effects in reducing the temperature difference generated on the heater between portions corresponding to paper feeding and non-paper feeding areas of recording paper in a previously executed fixing job, and in maintaining an even gloss level on a printed image by equalizing the fixing temperature in the width direction of recording paper, even when processing the recording paper having a wider width in a subsequent fixing job.

A first aspect of the present invention to address the above-described problems provides a fixing apparatus that executes a plurality of fixing jobs for recording paper having different widths; the fixing apparatus having a heater that includes a magnetic shunt alloy whose Curie temperature is set higher than a fixing temperature in each of the plurality of fixing jobs, an induction heater that generates an alternating magnetic field applied to the magnetic shunt alloy and performs electromagnetic-induction heating on the heater, and a heating controller that controls the induction heater so as to adjust the fixing temperature in each of the fixing jobs. The heating controller controls the induction heater so as to perform electromagnetic-induction heating on the heater, during a period from an end of a preceding fixing job to a start of a subsequent fixing job.

The above-described structure performs electromagnetic-induction heating on the heater during a period between fixing jobs (at least a portion thereof), regardless of adjustment of the fixing temperature in the preceding fixing job. The simple structure can thereby reduce in a short period of time the temperature difference generated on the heater between portions corresponding to paper feeding and non-paper feeding areas of recording paper in the preceding fixing job. Even when processing recording paper having a wider width in the subsequent fixing job, the structure can maintain an even gloss level on a printed image by equalizing the fixing temperature in the width direction of the recording paper.

For the control above by the heating controller during the period between the fixing jobs, the structure may be configured to execute the control until the temperature difference on the heater reaches within a predetermined range, the temperature difference being generated between the portions corresponding to the paper feeding and non-paper feeding areas of the recording paper in the preceding fixing job. Alternatively, the structure may be configured to execute the control until a reference time elapses, the reference time being set as an expected time that the temperature difference reaches within the predetermined range.

A second aspect of the present invention to address the above-described problems provides a structure where the heating controller controls the induction heater during the period between the fixing jobs, so as to increase the temperature of the portion of the heater corresponding to the paper feeding area of the recording paper in the preceding fixing job, to the fixing temperature or higher of the preceding fixing job.

The above-described structure performs electromagnetic-induction heating on the heater during the period between the fixing jobs, and thereby the temperature of the paper feeding area of the recording paper in the preceding fixing job is increased from the fixing temperature. Meanwhile, the temperature of the non-paper feeding area has already been relatively high in the preceding fixing job, and reaches near the Curie temperature first and thus the temperature is kept from increasing. The structure can thereby reduce in a short period of time the temperature difference generated on the heater between the portions corresponding to the paper feeding and non-paper feeding areas of the recording paper in the preceding fixing job.

A third aspect of the present invention to address the above-described problems provides a structure where the heating controller controls the induction heater so as to adjust the fixing temperature, based on a first preset temperature during execution of the preceding fixing job and on a second preset temperature (an average operation temperature) during the period between the fixing jobs.

The above-described structure allows easy control of the induction heater during execution of the fixing job and the period between the fixing jobs. The structure has an advantage where control of the induction heater during the period between the fixing jobs can be executed in a similar manner to the adjustment of the fixing temperature during execution of the fixing job. The first preset temperature herein is set at a temperature appropriate for a fixing process in the preceding fixing job. The second preset temperature is set appropriately so that the temperature difference generated on the heater between the portions corresponding to the paper feeding and non-paper feeding areas of recording paper in the preceding fixing job can be reduced, according to a type of recording paper, conditions for a fixing process, temperature unevenness on the heater, the number of paper fed, and the like of the subsequent fixing job.

A fourth aspect of the present invention to address the above-described problems provides a structure where the heating controller executes control of the induction heater during the period between the fixing jobs, when the recording paper width to be processed in the subsequent fixing job is wider than that in the preceding fixing job. The structure above allows execution of the control when the induction heater needs to be controlled during the period of the fixing jobs (i.e., the recording paper width in the subsequent fixing job is wider than that in the preceding fixing job), and thereby enables efficient processing.

A fifth aspect of the present invention to address the above-described problems provides a structure where the second preset temperature is equal to the fixing temperature in the subsequent fixing job. The structure above allows easier control of the induction heater during the period between the fixing jobs. Further, the structure enables smooth transition to the subsequent fixing job.

A sixth aspect of the present invention to address the above-described problems provides a structure where the heating controller stops operation of the induction heater after the preceding fixing job ends when no subsequent fixing job exits. The structure above eliminates an unnecessary heating process, and thus saves energy.

A seventh aspect of the present invention to address the above-described problems provides a structure where the second preset temperature is equal to or lower than the Curie temperature of the magnetic shunt alloy. The structure above shortens a time to reach the second preset temperature of the fixing temperature during the period between the fixing jobs (a pro form a fixing temperature for control purposes), thus allowing the subsequent fixing job to start in a short period of time.

An eighth aspect of the present invention to address the above-described problems provides a structure where the second preset temperature is equal to or higher than the Curie temperature of the magnetic shunt alloy. In the structure above, temperatures of portions of the heater corresponding to the paper feeding and non-paper feeding areas of recording paper in the preceding fixing job is substantially even, as both the temperatures reach near the Curie temperature. Thereby, the structure further ensures reduction in the temperature difference of the heater.

A ninth aspect of the present invention to address the above-described problems provides a structure that further includes a temperature detector that detects temperatures at a central portion and an end portion in an axis direction of the heater. When a temperature difference between the central and end portions falls within a reference value, the heating controller ends control of the induction heater during the period between the fixing jobs. The structure above can determine a level of evenness of the temperature difference generated on the heater between the portions corresponding to the paper feeding and non-paper feeding areas of the recording paper in the preceding fixing job, based on an appropriate index. The structure can further start the subsequent fixing job in a short period of time.

A tenth aspect of the present invention to address the above-described problems provides an image forming apparatus having the fixing apparatus according to the first through ninth aspects of the present invention.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the present invention are explained in the following, in reference to the above-described drawings.

Figure 1:
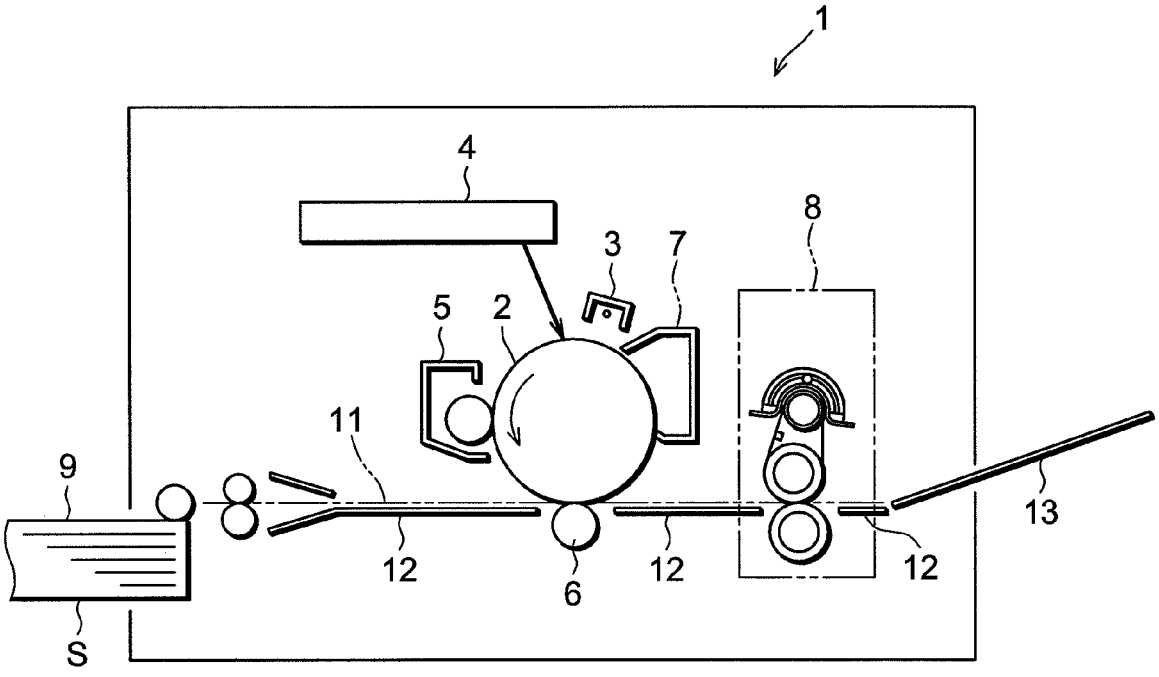
FIG. 1 is a pattern diagram illustrating a general configuration of an image forming apparatus according to the present invention.

FIG. 1 is a pattern diagram illustrating a general configuration of an image forming apparatus according to the present invention. Image forming apparatus 1 mainly includes photoconductive drum 2, charger 3, LSU (Laser Scanning Unit) 4, developer 5, transfer roller 6, cleaning apparatus 7, fixing apparatus 8, and paper feeder 9. Photoconductive drum 2 has an image forming surface on which a toner image is formed. Charger 3 evenly charges the image forming surface on photoconductive drum 2 to a predetermined electric potential. LSU 4 scans the evenly charged image forming surface through a laser light and forms an electrostatic latent image. Developer 5 develops the electrostatic latent image using toner. Transfer roller 6 is disposed opposite to photoconductive drum 2 and transfers the toner image on photoconductive drum 2 on recording paper S through application of transfer bias. Cleaning apparatus 7 removes toner and other substances that remain on the image forming surface of photoconductive drum 2 after the transfer. Fixing apparatus 8 fixes unfixed toner on the recording material, the toner being transferred to recording paper S. Paper feeder 9 stores recording paper S.

When a printing process (image forming process) is started at image forming apparatus 1, recording paper S of paper feeder 9 is sequentially transferred at a predetermined timing on guide member 12 provided along paper feeding path 11. When the toner image is transferred at a nip formed between photoconductive drum 2, which moves in the arrowed direction, and transfer roller 6. Then, fixing apparatus 8 performs a fixing process of the toner image and recording paper S is laid on ejecting tray 13 provided on an exterior portion of the apparatus. "Recording paper" used in the example is not limited to paper products in a strict meaning, but includes resin sheets and the like that can be used for image forming processes.

Figure 2:
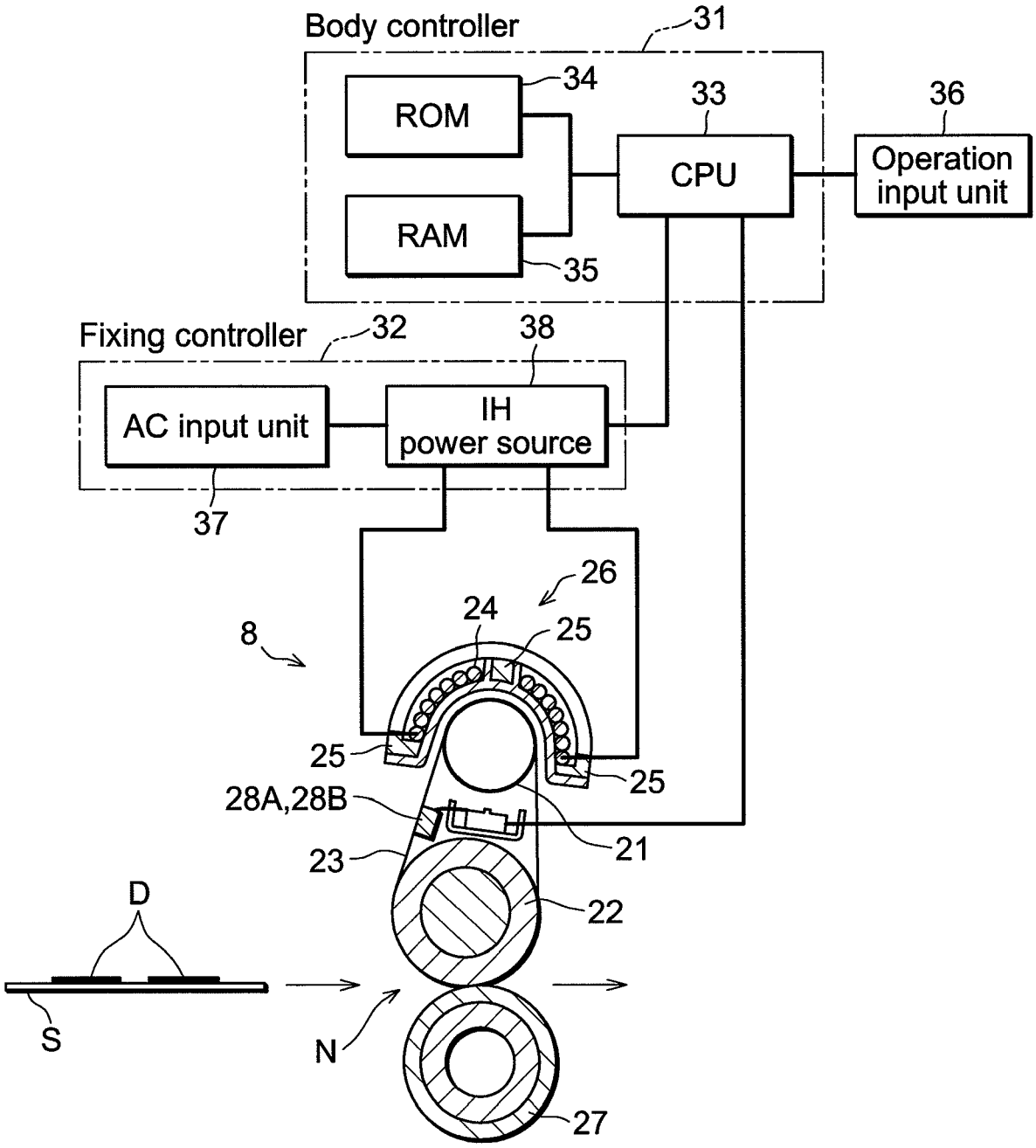
FIG. 2 is a pattern diagram illustrating a detailed configuration of a fixing apparatus of FIG. 1; and a configuration of its controller.

FIG. 2 is a pattern diagram illustrating a detailed configuration of the fixing apparatus shown in FIG. 1 and a configuration of its controller. Fixing apparatus 8 includes heat roller (heater) 21, fixing roller 22, fixing belt 23, induction heater 26, pressure roller 27, and thermistors (temperature detectors) 28A and 28B. Fixing roller 22 is provided in parallel to heat roller 21 and having a predetermined distance therefrom. Fixing belt 23 is mounted around heat roller 21 and fixing roller 22, and rotates along with rotation of fixing roller 22. Induction heater 26 includes core 25, which is provided opposite to and surrounding a portion of heat roller 21 and fixing belt 23. Core 25 includes strong magnetic objects, such as magnetizing coil 24, a ferrite, and the like, the magnetizing coil generating an alternating magnetic field for performing electromagnetic-induction heating on heat roller 21 and fixing belt 23. Pressure roller 27 is rotated and driven while being pressed against fixing roller 22 having fixing belt 23 in between. Pressure roller 27 provides fixing nip N at a portion where fixing belt 23 is wound around fixing roller 22, so as to pinch recording paper for a fixing process. Thermistors 28A and 28B are provided contacting an inner circumference of fixing belt 23 and detects a temperature near fixing nip N of fixing belt 23. Fixing apparatus 8 pressures and heats recording paper S, on which unfixed toner image D is formed, at fixing nip N with fixing belt 23 and pressure roller 27, so as to perform the fixing process, in which toner image D is melted and the image is fixed on recording paper S. As described hereinafter, fixing apparatus 8 can sequentially execute a plurality of fixing jobs at an appropriate interval. The fixing job constitutes a part of a printing process in image forming apparatus 1. The fixing job may be a fixing process of one sheet of recording paper or a collective fixing process of a plurality of sheets of recording paper having a same size (a same paper width). Recording paper having difference paper widths can be processed in each of the fixing jobs.

Fixing belt 23 can be provided with a polyimide film base (a heat-generating layer) containing, for examp silver particles. On the base, an elastic layer having silicone rubber and the like, and a surface release layer having PTFE, PFA, or the like alone or mixed resin, provided in layer in order. Base (heat-generating layer) material may also be an extremely thin metal of copper, nickel, stainless, magnetic shunt alloy, and the like. Heat roller 21 has magnetic shunt alloy. Heat roller 21 may also have a heat-generating layer plated with copper, nickel, or the like, other than the heat-generation layer of magnetic shunt alloy. The magnetic shunt alloy may be, for instance, a Fe—Ni alloy, whose magnetic permeability declines near a Curie temperature and which turns into non-magnetic over the Curie temperature. When the Fe—Ni alloy is used as the magnetic shunt alloy, adjusting a Ni content allows setting of the Curie temperature to a predetermined value. The magnetic shunt alloy according to the present invention is provided such that the alloy has the Curie temperature higher than a fixing temperature (a temperature of a portion of fixing belt 23 corresponding to a paper feeding area of recording paper S in a fixing process). Therefore, in a fixing job to process recording paper having a predetermined width, for instance, when the temperature of an end portion of heat roller 21 (a portion corresponding to a non-paper feeding area of recording paper) increases near the Curie temperature due to electromagnetic-induction heating by induction heater 26, the portion loses magnetism and heating efficiency significantly declines, and thereby the temperature is kept from increasing further.

In the present embodiment, induction heater 26 heats fixing belt 23 and heat roller 21. It is possible, however, not to provide a heat-generating layer to either fixing belt 23 or heat roller 21, so as to heat only either of the components. For instance, a fixing belt may be configured with a polyimide film base having no heat-generating layer, and the elastic and release layers provided as described above, so as to be indirectly heated by heat roller 21.

In addition, a surface layer of fixing roller 22 may be provided with silicone sponge and the like, for example. Further, a surface layer of pressure roller 27 may be provided with silicone rubber and the like.

Figure 3:
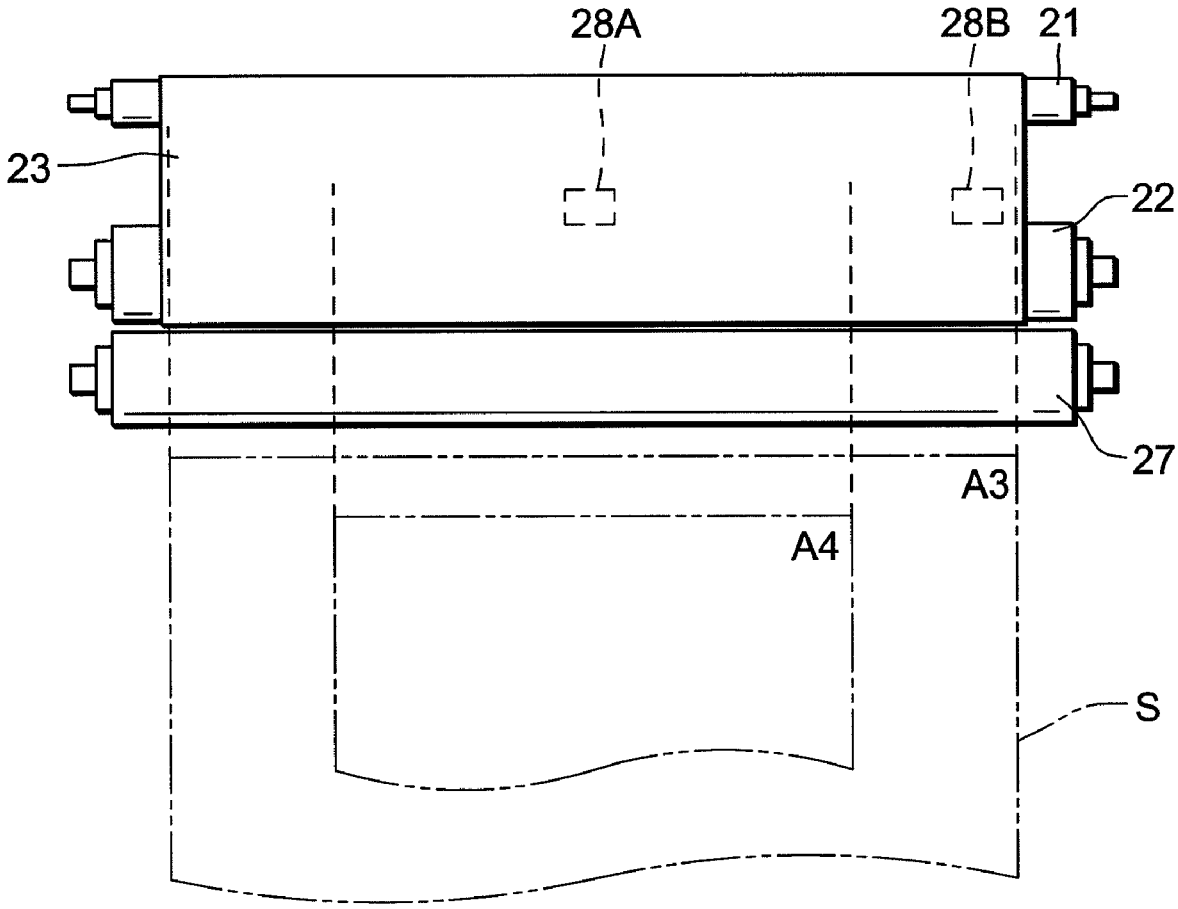
FIG. 3 illustrates a disposition of thermistors in the fixing apparatus.

As shown in FIG. 3, thermistors 28A and 28B are provided along a width direction of fixing belt 23 (perpendicular to a paper feeding direction of recording paper S). In the present embodiment, the maximum paper feeding width is set at A3 size (297 mm×420 mm). Center thermistor 28A detects a temperature of a central portion of fixing belt 23, while side thermistor 28B detects a temperature of an end portion where no A4 size (210 mm×297 mm) recording paper is fed (A4 non-paper feeding area) and A3 size recording paper is fed (A3 paper feeding area). Further, induction heater 26 heats fixing belt 23 and heat roller 21 in an area substantially corresponding to the maximum paper feeding width, regardless of a recording paper size to be processed. However, the heating area is not limited as above.

A controller of fixing apparatus 8 mainly includes body controller (heat controller) 31 and fixing controller 32. Body controller 31 is provided with CPU 33, ROM 34, and RAM 35. CPU 33 controls entire processing operations of fixing apparatus 8. ROM 34 stores control programs that allow CPU 33 to perform control. RAM 35 provides a work area for CPU 33 control. CPU 33 is connected to operation input unit 36, so as to obtain input information related to various operation instructions and settings entered by an operator. Further, fixing controller 32 is provided with AC input unit 37 and IH power source 38, which controls power input from AC input unit 37 to magnetizing coil 24.

In a fixing job, CPU 33 executes heating control so as to maintain the fixing temperature at fixing nip N to a temperature suitable for fixing unfixed toner image D. More specifically, CPU 33 obtains temperature data detected by center thermistor 28A and executes heating control such that the temperature of center thermistor 28A is close to a target temperature (hereinafter referred to as a "preset temperature"), which is set based on a type of recording paper and the like. CPU 33 herein sets a preset power value according to the data detected by center thermistor 28A; IH power source 38, following a command from CPU 33, controls power supplied to magnetizing coil 24 of induction heater 26 to the preset power value.

For instance, when sheets of recording paper having a predetermined width (e.g., A4 size) are continuously fed in a fixing job, a temperature difference occurs on fixing belt 23 and heat roller 21 between portions corresponding to paper feeding and non-paper feeding areas of the recording paper (i.e., a portion corresponding to the non-paper feeding area has a higher temperature than a portion corresponding to the paper feeding area, where the recording paper dissipates the heat). When recording paper having a wider width (e.g., A3 size) is fed in a subsequent fixing job, the fixing temperature may differ between the portions corresponding to the paper feeding and non-paper feeding areas of the recording paper, thus causing an uneven gloss level.

To address the problem above, CPU 33 executes heating control for averaging the temperature difference generated between portions corresponding to paper feeding and non-paper feeding areas of recording paper on fixing belt 23 and heat roller 21 (hereinafter referred to as "average heating control"), during a period between fixing jobs (i.e., a period from an end of a preceding fixing job to a start of a subsequent fixing job), regardless of heating control for adjusting the fixing temperature in the above-described fixing job. The average heating control can be executed in a similar manner to heating control in a fixing job, by setting the preset temperature in heating control executed in the fixing job to a temperature suitable for averaging the temperature difference on fixing belt 23 and heat roller 21. Such average heating control reduces the temperature difference in the axis direction on each of fixing belt 23 and heat roller 21, and thereby allows an even gloss level to be maintained on a printed image on recording paper in a subsequent job. In the present embodiment, a temperature difference between side thermistor 28B and center thermistor 28A is used as an index to determine the level of evenness of the temperature difference in the axis direction on fixing belt 23 and heat roller 21.

Figure 4:
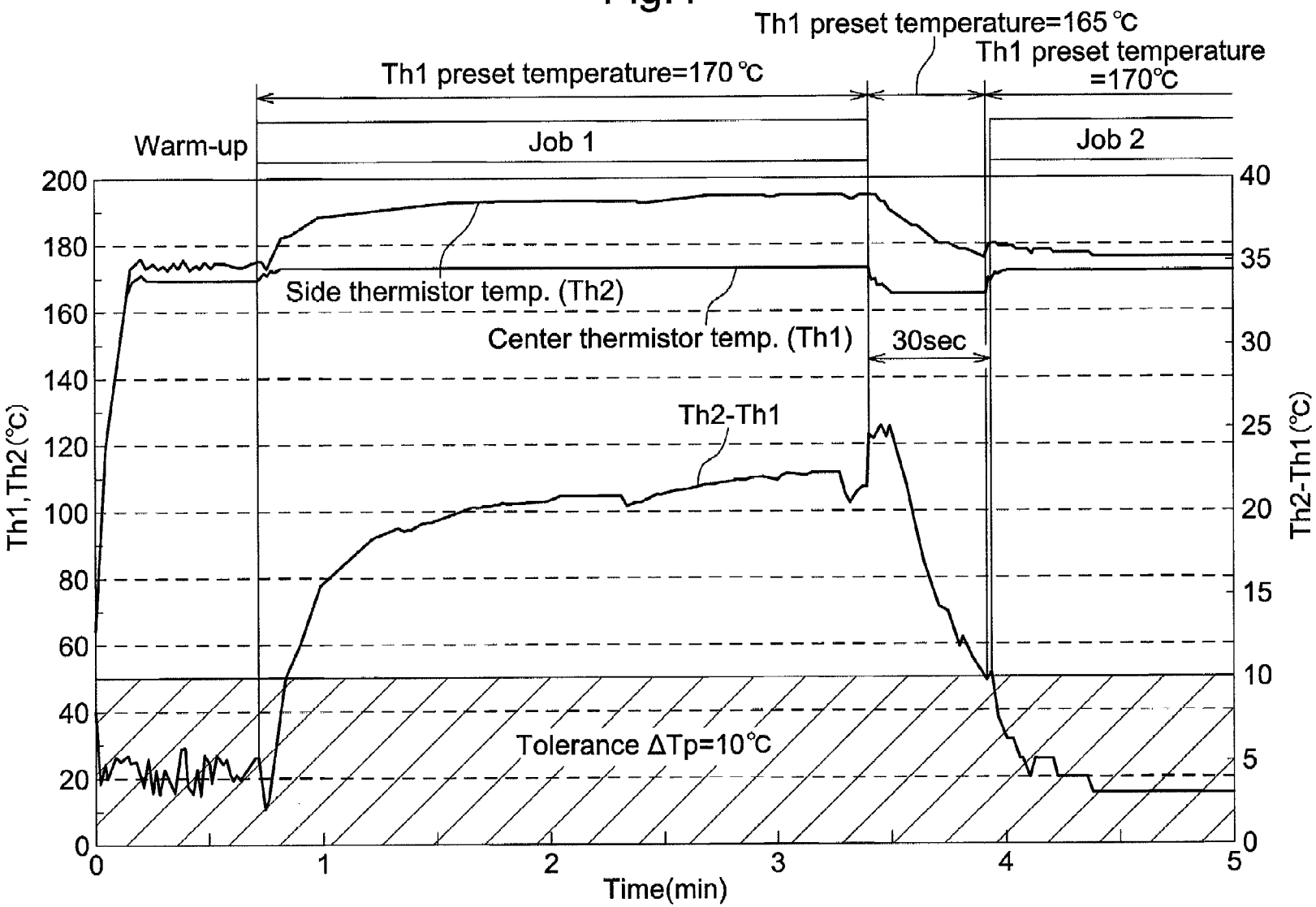
FIG. 4 illustrates an example of a temperature transition of a fixing belt when average heating control is performed.
Figure 5:
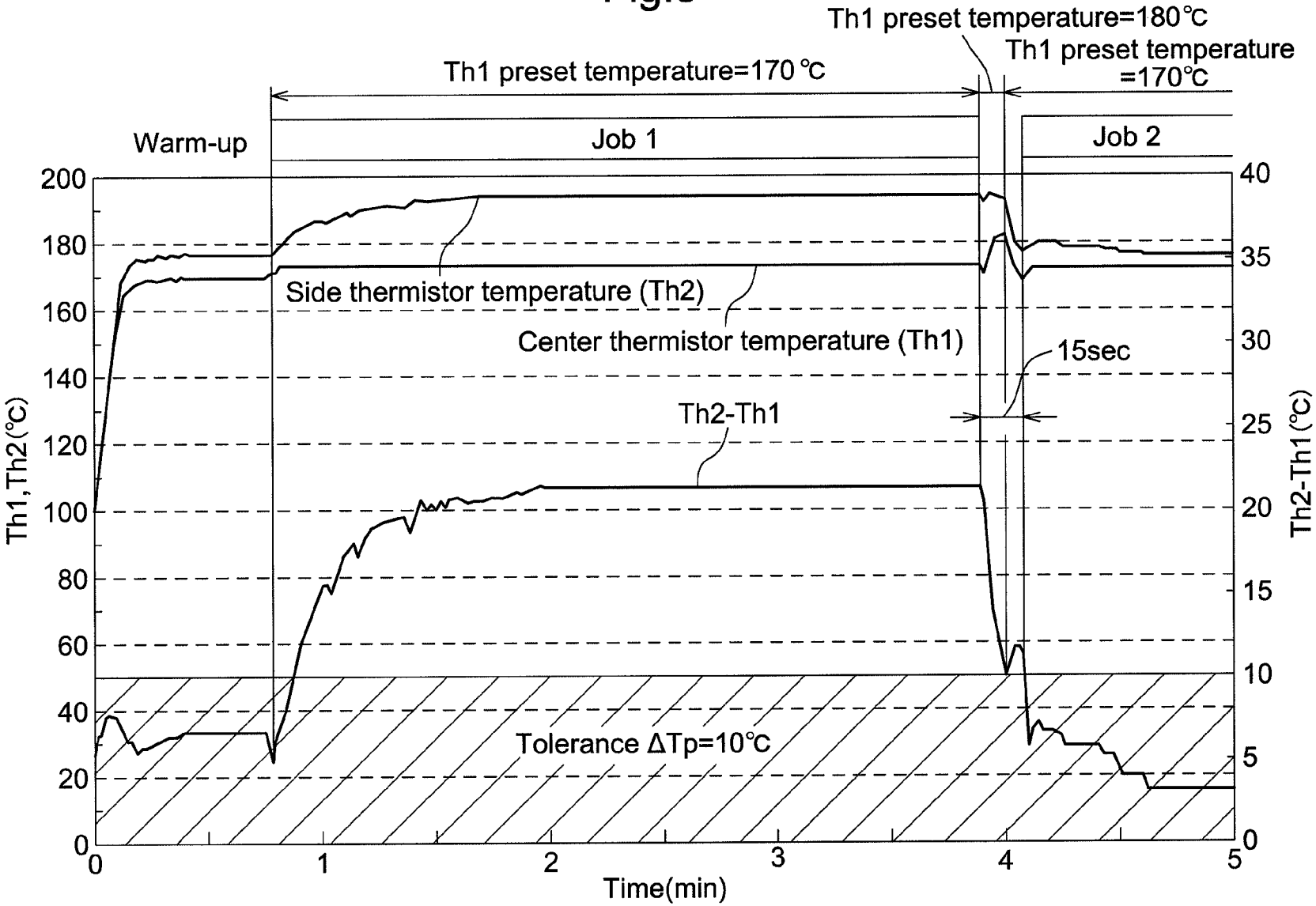
FIG. 5 illustrates an example of a temperature transition of a fixing belt when average heating control is performed.
Figure 6:
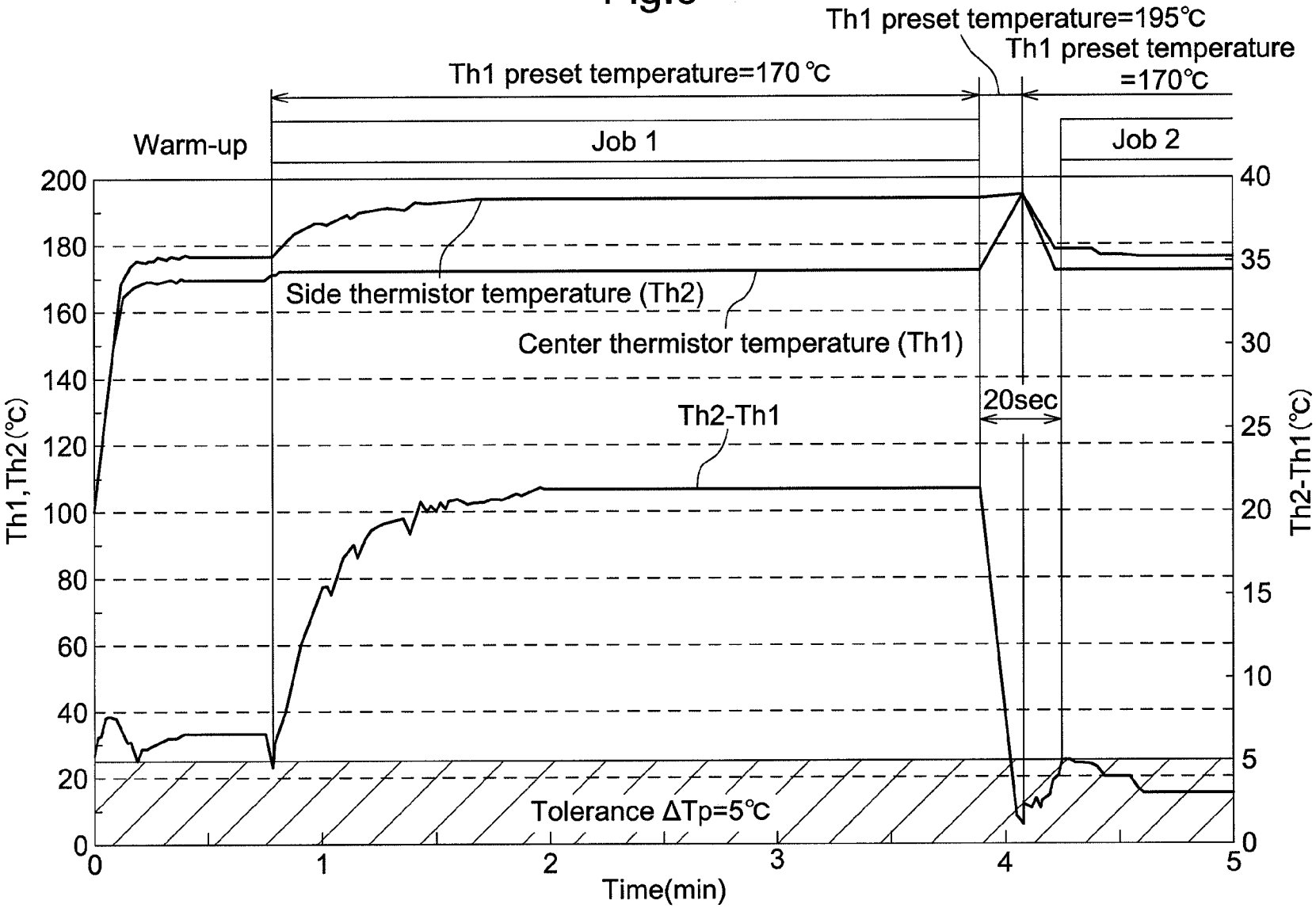
FIG. 6 illustrates an example of a temperature transition of a fixing belt when average heating control is performed.

FIGS. 4 through 6 are charts illustrating examples of a temperature transition of the fixing belt when average heating control is performed in the fixing apparatus according to the present invention. In average heating control, tolerance $\Delta Tp$ of deviation of the fixing temperature that generates no uneven gloss level on a printed image in a fixing job. Based on tolerance $\Delta Tp$, a reference value (a maximum tolerance value) is set for the temperature difference in the axis direction of fixing belt 23 and heat roller 21 before the fixing job starts. FIGS. 4 and 5 illustrate cases where tolerance ΔTp of deviation of the fixing temperature is 10° C. FIG. 6 illustrates a case where tolerance ΔTp of deviation of the fixing temperature is narrower (ΔTp=5° C.). In each figure, a left vertical axis indicates temperature Th1 (° C.) of center thermistor 28A and temperature Th2 (° C.) of side thermistor 28B; a right vertical axis indicates difference Th2−Th1 (° C) of temperature Th2 of side thermistor 28B and temperature Th1 of center thermistor 28A; a horizontal axis indicates a time elapsed (minutes) from a start of a fixing process (warm-up start). Temperature difference Th2−Th1 of the thermistors indicates deviation of the fixing temperature in the fixing job, and, during a period between fixing jobs, functions as an index to determine the level of evenness of the temperature difference in the axis direction of fixing belt 23 and heat roller 21.

The temperature transitions of the fixing belt are shown at post warm-up, Job 1 (preceding fixing job), and Job 2 (subsequent fixing job), which are sequentially executed. A4-size recording paper is processed in Job 1, and A3-size recording paper having a wider width is processed in Job 2. In Job 1, center thermistor 28A is positioned in the paper feeding area of the recording paper, while side thermistor 28B is positioned in the non-paper feeding area of the recording paper, as shown in FIG. 3. In Job 2, both center thermistor 28A and side thermistor 28B are positioned in the paper feeding area of the recording paper.

In each figure, when warm-up is completed, a preset temperature for Th1 is set at 170° C. and a fixing process is executed in Job 1. At this point, side thermistor 28B is positioned in the non-paper feeding area. Temperature difference Th2−Th1 of the thermistors is thus out of tolerance ΔTp (10° C. or 5° C.), while the fixing temperature within the recording paper width falls within tolerance ΔTp. Meanwhile, an area which was the non-paper feeding area in Job 1 is the paper feeding area in Job 2, and thus it is necessary to take a measure to set deviation of the fixing temperature (i.e., temperature difference Th2−Th1 of the thermistors herein) within tolerance ΔTp. To this end, fixing apparatus 8 executes average heating control during a period between fixing jobs (from an end of Job 1 to a start of Job 2). When the recording paper width processed in Job 2 is equal to or narrower than that processed in Job 1, average heating control can be omitted since the temperature in the area within the recording paper width of Job 1 is maintained within the tolerance. As described above, executing average heating control only when required during the period between fixing jobs allows efficient processing.

In FIG. 4, when Job 1 ends, the preset temperature of center thermistor 28A is set at a temperature lower (165° C.) than the preset temperature in Job 1, and average heating control starts. At this point, temperature Th2 of side thermistor 28B (i.e., the temperature of the portion corresponding to the non-paper feeding area of the A4-size recording paper on fixing belt 23) at the end of Job 1 is about 193° C., and temperature Th1 of center thermistor 28A (i.e., the temperature of the portion corresponding to the paper feeding area of the recording paper) is about 170° C.

Figure 7:
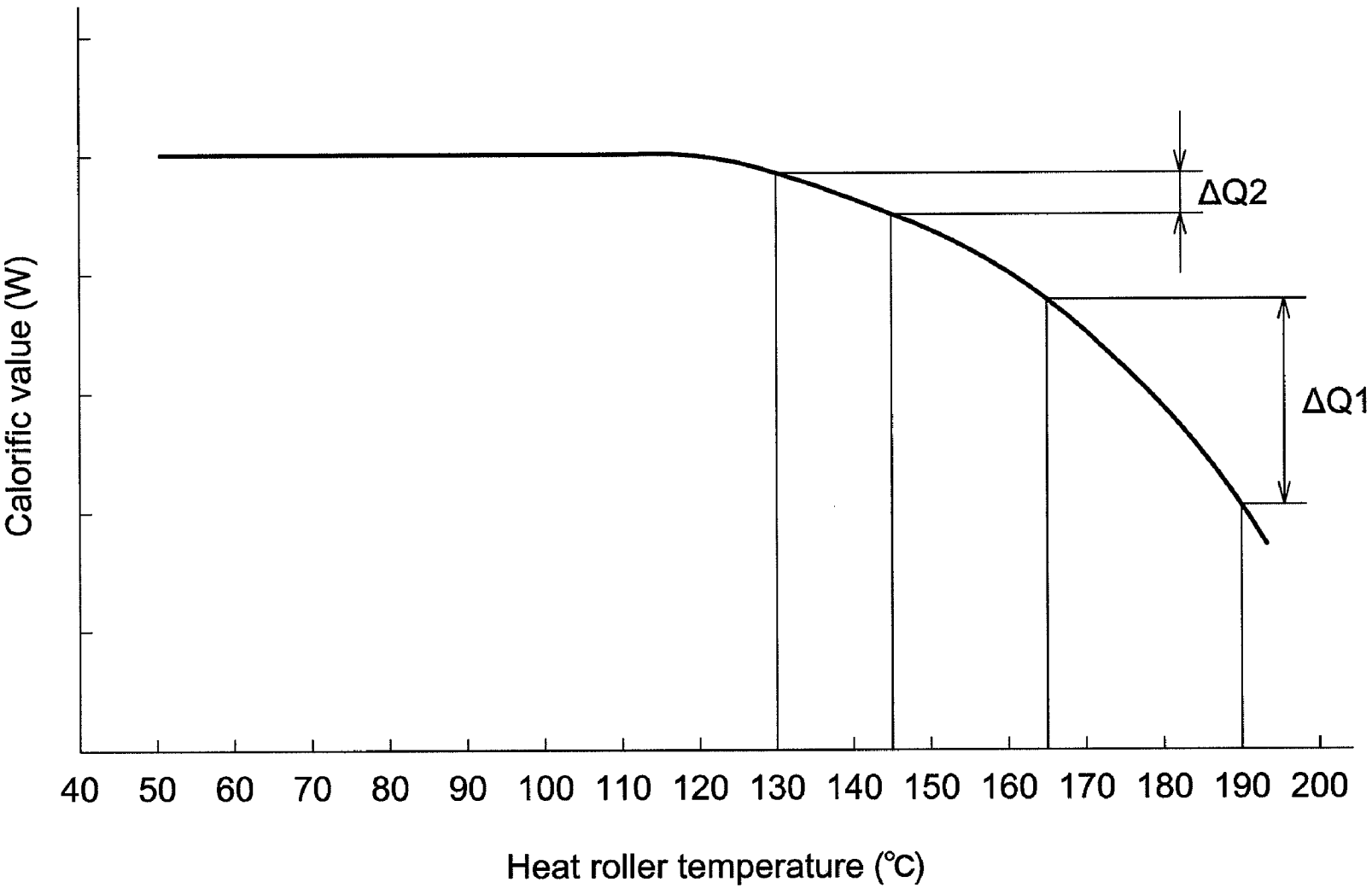
FIG. 7 illustrates an example of a change in a calorific value in relation to a temperature difference of a heat roller.

On heat roller 21 herein, the heating efficiency gradually decreases as the temperature increases toward the Curie temperature of the magnetic shunt alloy, which constitutes the heat-generating layer thereof. Thus, even when the power continues to be supplied to magnetizing coil 24 at the same level, calorific value thereof decreases as the temperature (a range of about 130° C. or more in this case) increases as shown in FIG. 7, for example. Therefore, when the preset temperature is set at 165° C. during a period between jobs after the end of Job 1, the calorific value is less in the non-paper feeding area, where side thermistor 28B is positioned and the temperature is high, than the paper feeding area, where center thermistor 28A is positioned. Thus, even after temperature Th1 of center thermistor 28A is maintained at 165° C., temperature Th2 of side thermistor 28B is further decreases. Then, when temperature difference Th2−Th1 of the thermistors decreases below a predetermined reference value (10° C. herein), the preset temperature of center thermistor 28A is set at 170° C. (the preset temperature in Job 2). Thereafter, when temperature Th1 of center thermistor 28A reaches near the preset temperature, Job 2 starts. In this example, the reference value to temperature difference Th2−Th1 of the thermistors in average heating control is set equal to tolerance ΔTp of deviation of the fixing temperature. However, the setting is not limited as above, and may be changed within a range of tolerance ΔTp of deviation of the fixing temperature of Job 2.

Performing such average heating control sets the fixing temperature in Job 2 within a range of tolerance ΔTp. In this case, a stop time of the fixing process (i.e., a time from the end of Job 1 to the start of Job 2) is about 30 seconds.

Figure 8:
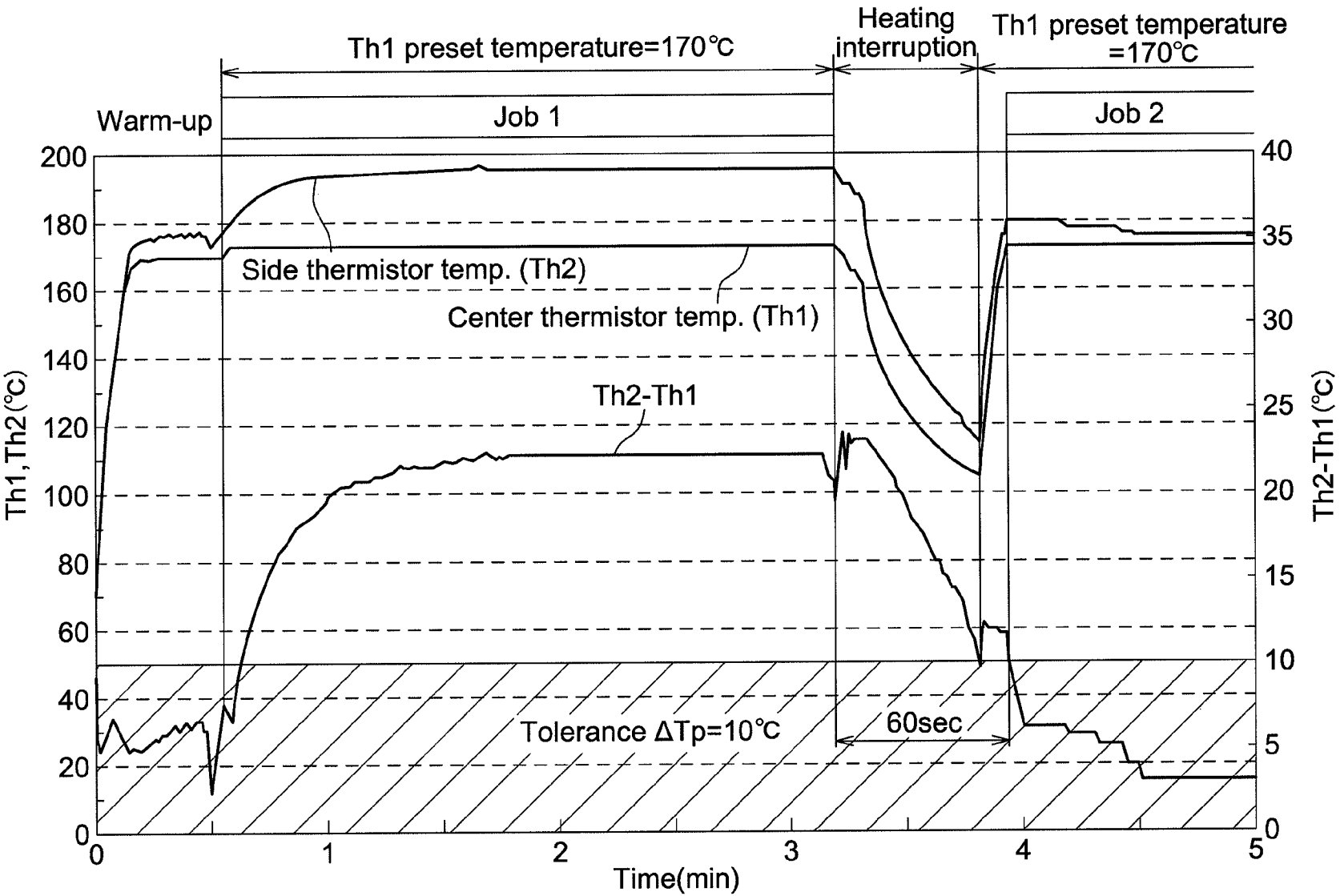
FIG. 8 is an example of a temperature transition of a fixing belt when average heating control is not performed.

FIG. 8 illustrates as a comparison example a case where above-described average heating control is not performed during a period between fixing jobs and the components are left to stand (natural cooling). Descriptions are the same as those for FIG. 4 unless otherwise particularly mentioned below. In FIG. 8, when Job 1 ends, temperature Th1 of center thermistor 28A and temperature Th2 of side thermistor 28B gradually decline. It takes 60 seconds before temperature difference Th2−Th1 of the thermistors eventually decreases below the reference value (10° C. herein) so as to allow the process of Job 2 to start. Therefore, when average heating control shown in FIG. 4 is executed, it is confirmed that the fixing process stop time can be substantially shortened, compared to the case where no average heating control is performed.

The preset temperature for average heating control in FIG. 4 does not need to be set at the temperature described herein (165° C.), but may be set at a desired value equal to or less than the fixing temperature of Job 1 (170° C.) with consideration of points described below.

A level of calorific value decline shown in FIG. 7 tends to become high as the temperature of fixing belt 23 increases. More specifically, in FIG. 7, for instance, when ΔQ1 is a difference of the calorific value when Th1=165° C. and Th2=190° C. at a preset temperature of 165° C.; and ΔQ2 is a difference of the calorific value when Th1=130° C. and Th2=145° C. at a preset temperature is 130° C., which is lower; then, ΔQ2 is less than ΔQ1. Thus, when the preset temperature is set at a lower temperature, the calorific value difference is smaller between the non-paper feeding area, where side thermistor 28B is positioned, and the paper feeding area, where center thermistor 28A is positioned. Consequently, it is difficult to reduce temperature difference Th2−Th1 of the thermistors (i.e., It takes longer before temperature difference Th2−Th1 decreases below the reference value). When the preset temperature is set to equal to or lower than a predetermined temperature (about 105° C. or lower herein), the transition is the same as the case where no average heating control shown in FIG. 8.

Thus, it is preferable to set the preset temperature for average heating control near the preset temperature in Job 2, where a calorific value difference is generally large. In particular, setting the preset temperature for average heating control equal to the preset temperature in the subsequent fixing job (170° C. herein) allows easy execution of average heating control during the period between the fixing jobs, and smooth transition to the subsequent fixing job.

Next, in FIG. 5, when Job 1 ends, the preset temperature of center thermistor 28A is set at a temperature higher (180° C.) than the preset temperature in Job 1, and average heating control starts. At this point, temperature Th1 of center thermistor 28A increases from the fixing temperature of Job 1 (170° C.) toward a preset temperature of 180° C., while temperature Th2 of side thermistor 28B is kept from increasing due to decline in the heating efficiency, as the temperature is already near the Curie temperature (200° C. herein). Thereby, temperature difference Th2−Th1 of the thermistors can be lowered below the reference value (10° C.) in a short period of time. When temperature difference Th2−Th1 of the thermistors decreases below the reference value, the preset temperature for center thermistor 28A is set at 170° C. (the preset temperature in Job 2), and then Job 2 starts when temperature Th1 of center thermistor 28A reaches near the preset temperature.

Setting the preset temperature close to the Curie temperature and performing average heating control enable the fixing temperature in Job 2 to set within tolerance ΔTp. In this case, the fixing process stop time is about 15 seconds. The fixing process stop time can thus be further shortened compared to the case in FIG. 4.

Next, in FIG. 6, when Job 1 ends, the preset temperature of center thermistor 28A is set at a temperature higher (210° C.) than the Curie temperature (200° C.) of magnetic shunt alloy, and average heating control starts. At this point, temperature Th1 of center thermistor 28A increases from the fixing temperature of Job 1 (170° C.) toward a preset temperature of 210° C., while temperature Th2 of side thermistor 28B is kept from increasing due to decline in the heating efficiency, as the temperature is already near the Curie temperature. When temperature Th1 of center thermistor 28A eventually reaches near the Curie temperature as temperature Th2 of side thermistor 28B has reached, the heating efficiency declines and thus the temperature is kept from increasing. Thereby, temperature difference Th2−Th1 of the thermistors can be substantially 0. When temperature difference Th2−Th1 of the thermistors is substantially 0, the preset temperature for center thermistor 28A is set at 170° C. (the preset temperature in Job 2). Thereafter, when temperature Th1 of center thermistor 28A reaches near the preset temperature, Job 2 starts.

Performing average heating control, where the preset temperature is set equal to or higher than the Curie temperature, can set the fixing temperature in Job 2 within a narrower range of tolerance ΔTp. Thus, it is suitable for a fixing process of material particularly prone to gloss unevenness, such as gloss paper, overhead projector film, and the like. In this case, the fixing process stop time is about 20 seconds. The fixing process stop time can thus be substantially shortened compared to the case shown in FIG. 8 where no average heating control is performed.

Figure 9:
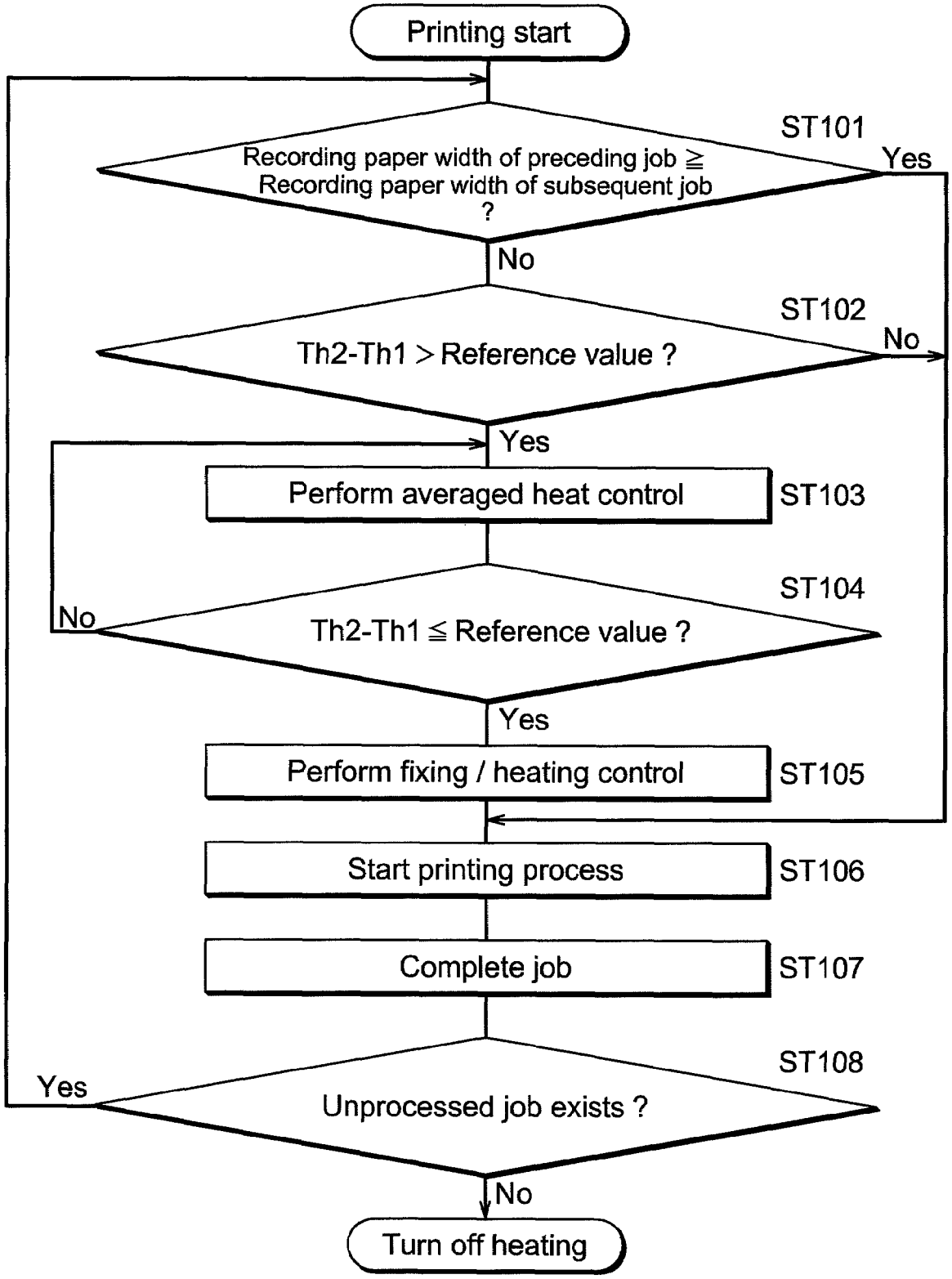
FIG. 9 is a flowchart illustrating a procedure of a first average heating control of the fixing apparatus.

FIG. 9 is a flowchart illustrating a procedure of a first average heating control of the fixing apparatus according to the present invention. In the first average heating control, whether to perform average heating control is determined based on temperature difference Th2−Th1 of the thermistors.

When image forming apparatus 1 starts a printing process, CPU 33 first determines, based on input information from operation input unit 36, whether or not a recording paper width in a preceding fixing job (hereinafter referred to as a "preceding job") is wider than a recording paper width in a fixing job to be executed subsequently (hereinafter referred to as a "subsequent job") (ST 101). When the recording paper width in the subsequent job is wider than that in the preceding job, CPU 33 determines, based on detected temperatures Th1 and Th2 of thermistors 28A and 28B, whether or not temperature difference Th2−Th1 exceeds a predetermined reference value (e.g., 10° C.) (ST 102).

When temperature difference Th2−Th1 of the thermistors exceeds the reference value, CPU 33 starts executing average heating control during a period between fixing jobs (a period from the end of the preceding job to the start of the subsequent job herein) (ST 103). In the step, in order to equalize the temperature difference generated between portions corresponding to paper feeding and non-paper feeding areas of recording paper on fixing belt 23 and heat roller 21 in the preceding job, CPU 33 sets a preset temperature of center thermistor 28A, regardless of heating control for adjusting a fixing temperature in the preceding job. The preset temperature during the period between the jobs may be set at a temperature lower (e.g., 165° C.) than the preset temperature in the preceding job (e.g., 170° C.). In order to shorten a fixing process stop time, however, it is preferable to set at a temperature higher (e.g., 180° C.) than the preset temperature in the preceding job. In addition, for an overhead projector film and the like, which are prone to an uneven gloss level and have narrow tolerance ΔTp of deviation of the fixing temperature, the preset temperature during the period between the jobs can be set near a Curie temperature (e.g., 200° C.) or higher (e.g., 210° C.).

Subsequently, when CPU 33 determines that temperature difference Th2−Th1 of the thermistors has decreased below the predetermined reference value (ST 104: Yes), CPU 33 changes the preset temperature of center thermistor 28A to a preset temperature in the subsequent job (e.g., 170° C.), and starts heating control in a normal fixing job (ST 105). When the temperature of fixing belt 23 reaches near the preset temperature, a printing process for the subsequent job starts (ST 106). When the subsequent job ends (ST 107), CPU 33 determines whether or not a job exists which was received at operation input unit 36 and has not been processed (ST 108). When an unprocessed job exists, the procedure returns to ST 101 and executes the same operations as described above. In the process, the above-described subsequent job is treated as a preceding job for a new fixing job.

When CPU 33 determines in ST 101 that the recording paper width in the subsequent job is equal to or narrower than that in the preceding job, or when CPU 33 determines in ST 102 that temperature difference Th2−Th1 of the thermistors is equal to or less than the predetermined reference value, CPU 33 determines that average heating control is unnecessary during the period between the fixing jobs, and starts the printing process for the subsequent job without executing average heating control (ST 106). Further, when no preceding job exists in ST 101 immediately after image forming apparatus 1 starts up, or when a predetermined time or longer has elapsed since the preceding job was executed, CPU 33 similarly determines that average heating control is unnecessary. Eventually, when all fixing jobs are executed (ST 108: No), a series of procedure ends.

Figure 10:
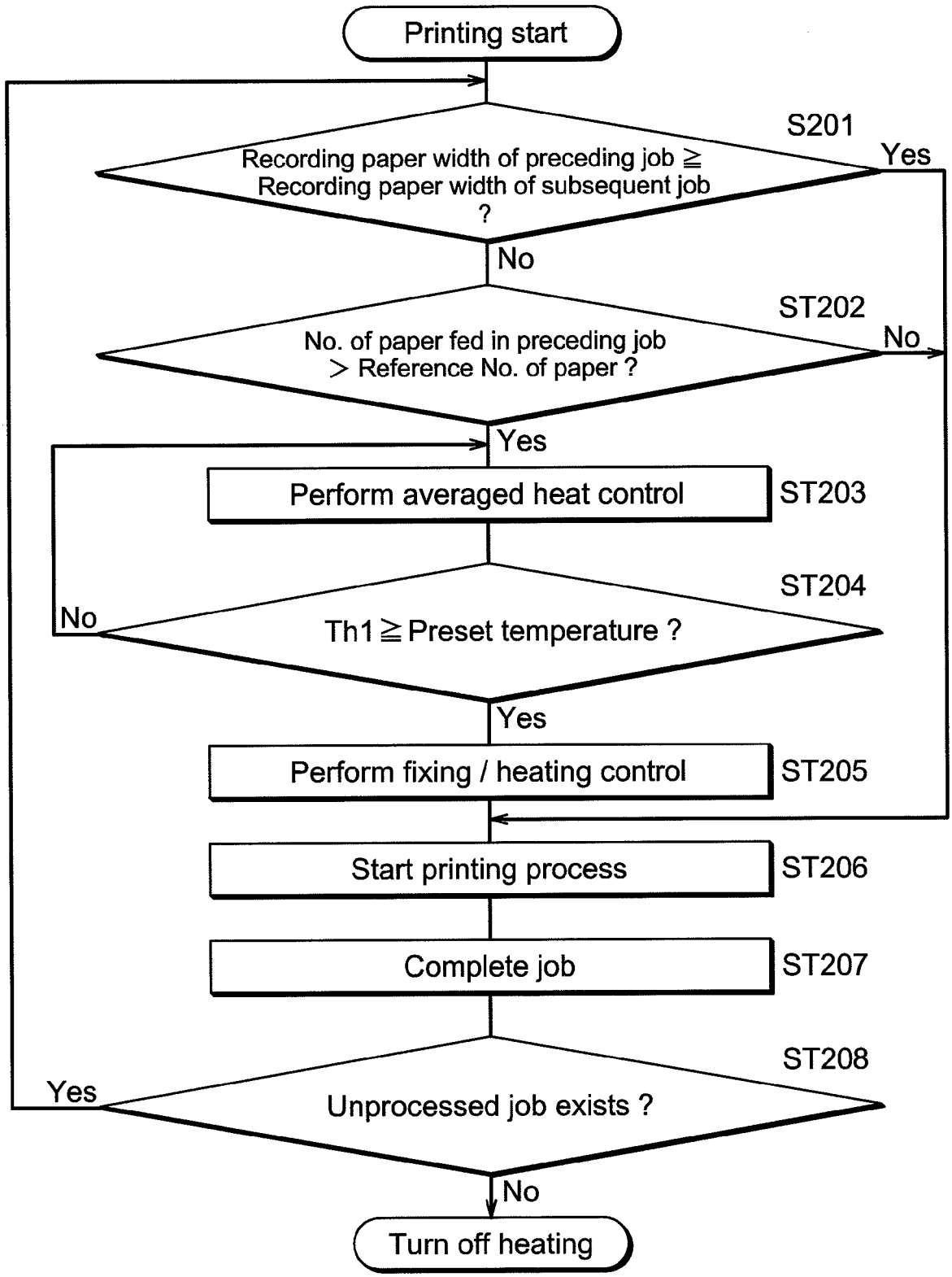
FIG. 10 is a flowchart illustrating a procedure of a second average heating control of the fixing apparatus.

FIG. 10 is a flowchart illustrating a procedure of a second average heating control of the fixing apparatus according to the present invention. The second average heating control is different from the first average heating control shown in FIG. 9, in that execution of average heating control is determined based on the number of fed paper (the number of processed sheets) in a preceding job. An advantage of the second average heating control, whose execution is determined based on the number of fed paper, is that side thermistor 28B as shown in FIG. 3 is not required, and thus that average heating control can be executed with a simple structure. In FIG. 10, ST 201 and ST 205 to ST 208 correspond to ST 101 and ST 105 to ST 108 shown in FIG. 9. Descriptions on the second average heating control are the same as those for the first average heating control, unless otherwise particularly mentioned below.

In ST 201, when a recording paper width in a subsequent job is wider than that in a preceding job, CPU 33 determines, based on input information from operation input unit 36, whether the number of fed paper in the preceding job exceeds a predetermined reference number of sheets (ST 202). The reference number of sheets is set such that when the subsequent job starts within a predetermined time (e.g., 30 seconds) with no execution of average heating control after the preceding job ends, a deviation of a fixing temperature in the subsequent job falls within tolerance ΔTp. When the number of fed paper in the preceding job exceeds the reference number of sheets, CPU 33 starts executing average heating control during a period between the fixing jobs.

In the step, a preset temperature during the period between the jobs may be set at a temperature between a fixing temperature of the preceding job and a Curie temperature of magnetic shunt alloy (e.g., 195° C.), considering tolerance ΔTp of deviation of the fixing temperature. In order to minimize deviation of the fixing temperature, however, it is preferable to set the temperature equal to or higher than the Curie temperature (e.g., 210° C.) of the magnetic shunt alloy. Thereby, temperature difference Th2−Th1 of the thermistors can be set substantially at 0. Then, when CPU 33 determines that temperature Th1 of center thermistor 28A increases higher than the preset temperature (ST 204: Yes), CPU 33 subsequently executes ST 205 to ST 208, similar to ST 105 to ST 108 in FIG. 9.

Figure 11:
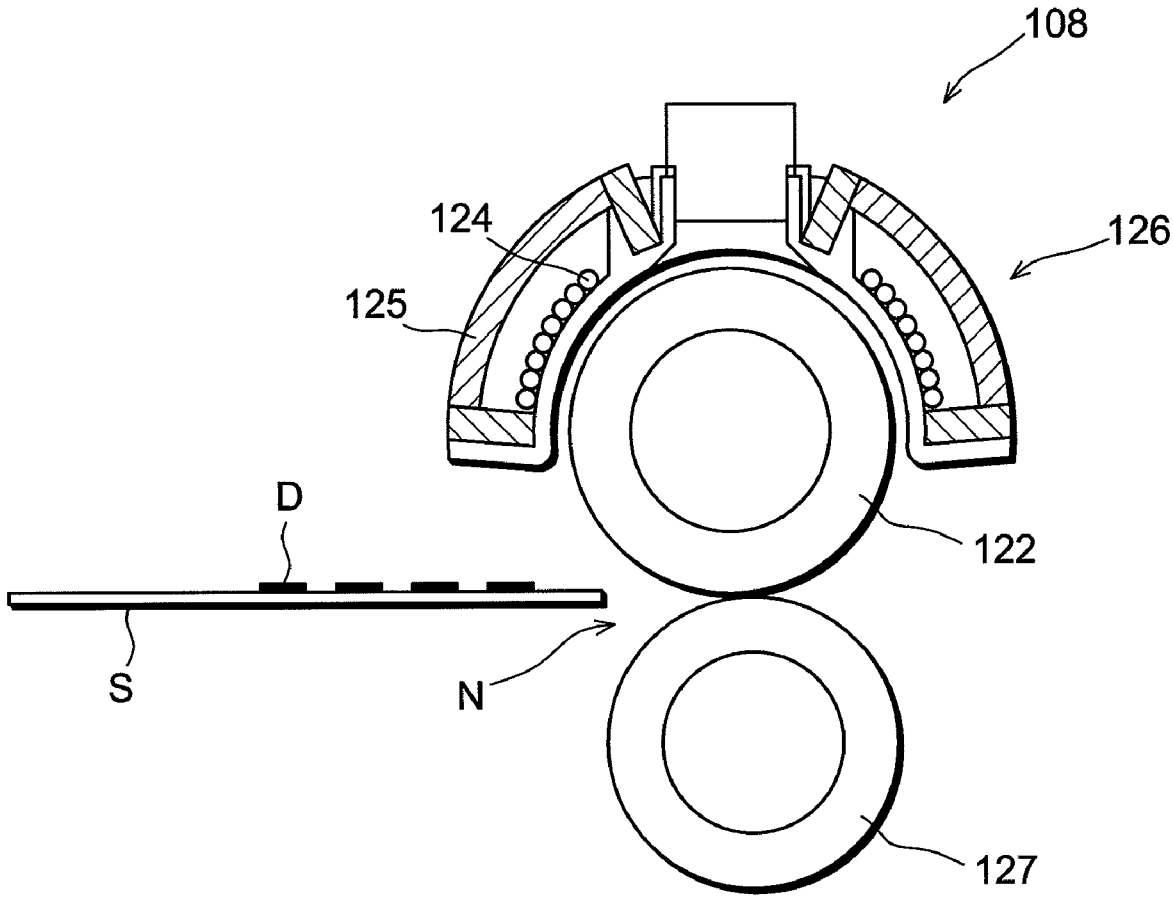
FIG. 11 is an example of a first variation of the fixing apparatus shown in FIG. 2.

FIG. 11 is an example of a first variation of the fixing apparatus shown in FIG. 2. Fixing apparatus 108 includes fixing roller (heater) 122, induction heater 126, and pressure roller 127. Fixing roller 122 has a heat-generating layer that includes magnetic shunt alloy, similar to heat roller 21 shown in FIG. 2. Induction heater 126 includes core 125, which is provided opposite to and surrounding a portion of fixing roller 122. Core 125 includes strong magnetic objects, such as magnetizing coil 124, a ferrite, and the like, the magnetizing coil generating an alternating magnetic field for performing electromagnetic-induction heating on fixing roller 122. Pressure roller 127 is rotated and driven while being pressed against fixing roller 122. Pressure roller 127 provides fixing nip N at a portion with fixing roller 122, so as to pinch recording paper for a fixing process. Fixing apparatus 108 pressures and heats recording paper S, on which unfixed toner image D is formed, at fixing nip N with fixing roller 122 and pressure roller 127, so as to perform the fixing process, in which toner image D is melted and the image is fixed on recording paper S. Although not shown in the figure, fixing apparatus 108 is provided with a temperature detector, similar to the controller and thermistors 28A and 28B shown in FIG. 2. Although not explained herein, fixing apparatus 108 having the above-described structure can also execute average heating control similar to the fixing apparatus shown in FIG. 2.

Figure 12:
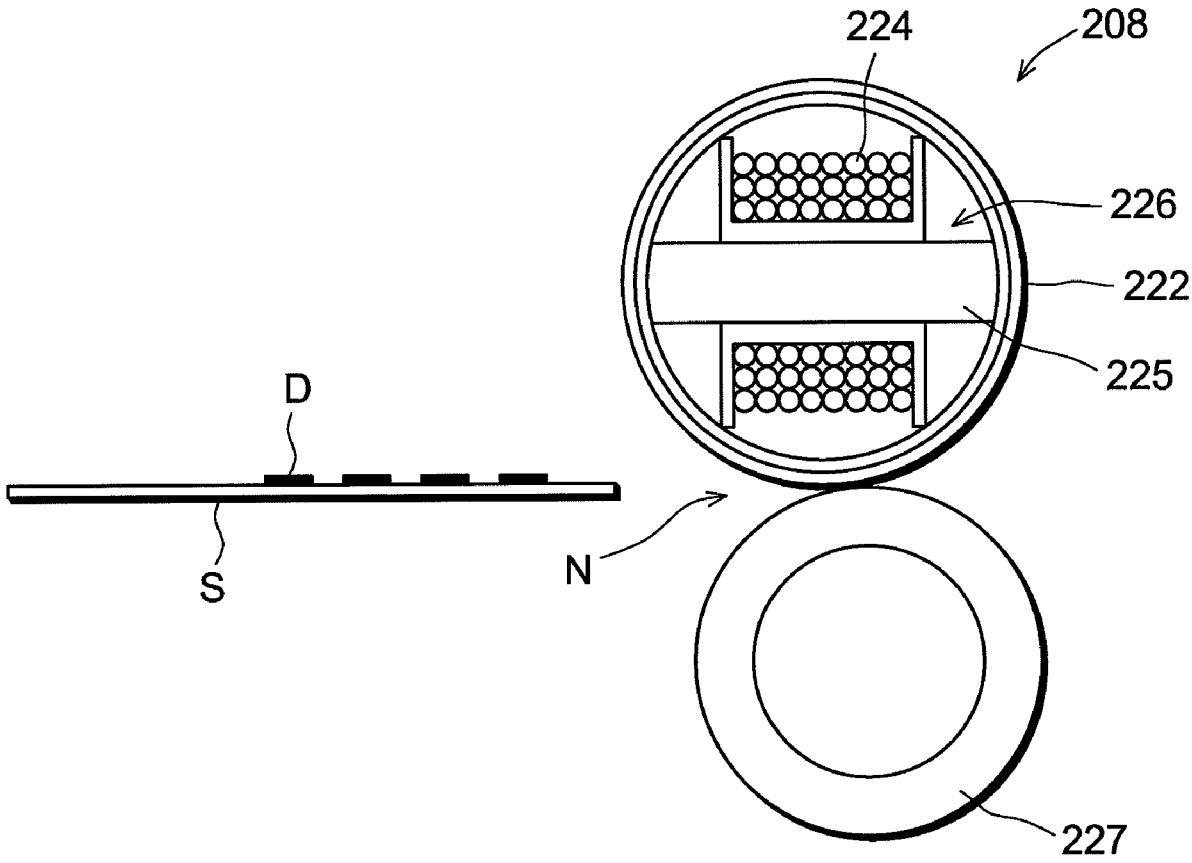
FIG. 12 is an example of a second variation of the fixing apparatus shown in FIG. 2.

FIG. 12 is an example of a second variation of the fixing apparatus shown in FIG. 2. Fixing apparatus 208 includes fixing roller (heater) 222, induction heater 226, and pressure roller 227. Fixing roller 222 has a heat-generating layer that includes magnetic shunt alloy, similar to heat roller 21 shown in FIG. 2. Induction heater 226 includes core 225, which is provided inside fixing roller 222 and includes strong magnetic objects, such as magnetizing coil 224, a ferrite, and the like, the magnetizing coil generating an alternating magnetic field for performing electromagnetic-induction heating on fixing roller 222. Pressure roller 227 is rotated and driven while being pressed against fixing roller 222. Pressure roller 227 provides fixing nip N at a portion with fixing roller 222, so as to pinch recording paper for a fixing process. Fixing apparatus 208 pressures and heats recording paper S, on which unfixed toner image D is formed, at fixing nip N with fixing roller 222 and pressure roller 227, so as to perform the fixing process, in which toner image D is melted and the image is fixed on recording paper S. Although not shown in the figure, fixing apparatus 208 is provided with a temperature detector, similar to the controller and thermistors 28A and 28B shown in FIG. 2. Although not explained herein, fixing apparatus 208 having the above-described structure can also execute average heating control similar to the fixing apparatus shown in FIG. 2.

The fixing apparatus and the image forming apparatus according to the present invention have a simple structure that can reduce the temperature difference generated on the heater between portions corresponding to paper feeding and non-paper feeding areas of a recording paper in a previously executed job. Even when processing a recoding paper having a wider width in a subsequent job, the structure equalizes the fixing temperature in the width direction of the recording paper so as to maintain an even gloss level on a printed image. Thereby, the structure is effective as a fixing apparatus that employs an electromagnetic-induction heating method and an image forming apparatus provided with such a fixing apparatus.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2006-250896 filed on Sep. 15, 2006, entire content of which is expressly incorporated by reference herein.

What is claimed is:

1. A fixing apparatus that executes a plurality of fixing jobs for recording paper having different widths, the fixing apparatus comprising:

a heater that includes a magnetic shunt alloy having a Curie temperature set higher than a fixing temperature in each of the plurality of fixing jobs;

an induction heater that generates an alternating field applied to said magnetic shunt alloy and performs electromagnetic-induction heating on said heater, wherein the induction heater surrounds a portion of said heater; and a heating controller that controls said induction heater so as to adjust the fixing temperature in each of the fixing jobs, wherein:

said heating controller controls said induction heater so as to perform electromagnetic-induction heating on said heater, during a period from an end of a preceding fixing job to a start of a subsequent fixing job, and said heating controller further controls said induction heater so as to adjust the fixing temperature, based on a first preset temperature during execution of the preceding fixing job, and on a second preset temperature during the period between the fixing jobs.

2. The fixing apparatus according to claim 1, wherein said heating controller controls said induction heater during the period between the fixing jobs, so as to increase a temperature of a portion of said heater corresponding to a paper feeding area of recording paper in the preceding fixing job, to the fixing temperature or higher of the preceding fixing job.

3. The fixing apparatus according to claim 1, wherein said heating controller executes control of said induction heater during the period between the fixing jobs, when the recording paper width to be processed in the subsequent fixing job is wider than that in the preceding fixing job.

4. The fixing apparatus according to claim 1, wherein said second preset temperature is equal to the fixing temperature in the subsequent fixing job.

5. The fixing apparatus according to claim 1, wherein said heating controller stops operation of said induction heater after the preceding fixing job ends when no subsequent fixing job exists.

6. The fixing apparatus according to claim 1, wherein said second preset temperature is equal to or lower than the Curie temperature of said magnetic shunt alloy.

7. The fixing apparatus according to claim 1, wherein said second preset temperature is equal to or higher than the Curie temperature of said magnetic shunt alloy.

8. An image forming apparatus having the fixing apparatus according to claim 1.

9. A fixing apparatus that executes a plurality of fixing jobs for recording paper having different widths, the fixing apparatus comprising:

a heater that includes a magnetic shunt alloy having a Curie temperature set higher than a fixing temperature in each of the plurality of fixing jobs:

an induction heater that generates an alternating field applied to said magnetic shunt alloy and performs electromagnetic-induction heating on said heater, wherein the induction heater surrounds a portion of said heater;

a heating controller that controls said induction heater so as to adjust the fixing temperature in each of the fixing jobs, wherein said heating controller controls said induction heater so as to perform electromagnetic-induction heating on said heater, during a period from an end of a preceding fixing job to a start of a subsequent fixing job; and temperature detectors that detect temperatures at a central portion and an end portion in an axis direction of said heater, wherein when a temperature difference between the central and end portions falls within a reference value, said heating controller ends control of said induction heater during the period between the fixing jobs.

10. A fixing apparatus that executes a plurality of fixing jobs for recording paper having different widths, the fixing apparatus comprising:

a heater that includes a magnetic shunt alloy having a Curie temperature set higher than a fixing temperature in each of the plurality of fixing jobs;

an induction heater that generates an alternating field applied to said magnetic shunt alloy and performs electromagnetic-induction heating on said heater; and a heating controller that controls said induction heater so as to adjust the fixing temperature in each of the fixing jobs, wherein said heating controller controls said induction heater so as to perform electromagnetic-induction heating on said heater, during a period from an end of a preceding fixing job to a start of a subsequent fixing job, and wherein said heating controller controls said induction heater so as to adjust the fixing temperature, based on a first preset temperature during execution of the preceding fixing job, and on a second preset temperature during the period between the fixing jobs.

11. A fixing apparatus that executes a plurality of fixing jobs for recording paper having different widths, the fixing apparatus comprising:

a heater that includes a magnetic shunt alloy having a Curie temperature set higher than a fixing temperature in each of the plurality of fixing jobs;

temperature detectors that detect temperatures at a central portion and an end portion in an axis direction of said heater;

an induction heater that generates an alternating field applied to said magnetic shunt alloy and performs electromagnetic-induction heating on said heater; and a heating controller that controls said induction heater so as to adjust the fixing temperature in each of the fixing jobs, wherein said heating controller controls said induction heater so as to perform electromagnetic-induction heating on said heater, during a period from an end of a preceding fixing job to a start of a subsequent fixing job, and wherein when a temperature difference between the central and end portions in the axis direction of said heater falls within a reference value, said heating controller ends control of said induction heater during the period between the fixing jobs.

* * * * *